US005095721A

United States Patent [19]

Negri

[11] Patent Number: 5,095,721

[45] Date of Patent: Mar. 17, 1992

[54] NEEDLE SECTION DEVICE HAVING ROCKER LEVERS IN A CIRCULAR MACHINE

[75] Inventor: Ettore Negri, Florence, Italy

[73] Assignee: Savio S.p.A., Pordenone, Italy

[21] Appl. No.: 518,920

[22] Filed: May 4, 1990

[30] Foreign Application Priority Data

May 11, 1989 [IT] Italy ..... 20444 A/89

[51] Int. Cl.[5] ..... D04B 15/78

[52] U.S. Cl. ..... 66/221

[58] Field of Search ..... 66/25, 75.2, 219, 221; 335/234

[56] References Cited

U.S. PATENT DOCUMENTS 3,530,686 9/1970 Martinetz ..... 66/221
4,856,300 8/1989 Lonati ..... 66/221
4,972,686 11/1990 Maruyama et al. ..... 66/221

FOREIGN PATENT DOCUMENTS 0219029 4/1987 European Pat. Off. .
0279309 8/1988 European Pat. Off. .
1196791 7/1965 Fed. Rep. of Germany ..... 335/234
WO8100730 3/1981 PCT Int'l Appl. ..... 66/75.2
2036811 7/1980 United Kingdom .
2213503 8/1989 United Kingdom ..... 66/221

*Primary Examiner*—Werner H. Schroeder
*Assistant Examiner*—John J. Calvert
*Attorney, Agent, or Firm*—Shea & Gould

[57] ABSTRACT

A device for selecting needles in a circular knitting machine by means of rocker levers. The rocker levers are pivoted on central horizontal fixed pivots having an end in the form of a one-piece metal structure. The metal structure comprises a sleeve which engages the horizontal pivot. The pivot engages along a gradual profile with butts of jacks. The butts of the jacks are inactivated and their opposite end engages with a mobile rocker arm of an electromagnetic actuator. The rocker arm is magnetizable by an electric current which is fed to a fixed electrical winding surrounding the arm. Depending on the direction of the current flowing through the winding, the rocker arm positions itself in one of two positions. The position is determined by fixed permanent magnets of opposite sign which are positioned on opposite sides of the mobile end of the magnetizable rocker arm.

6 Claims, 3 Drawing Sheets

NEEDLE SECTION DEVICE HAVING ROCKER LEVERS IN A CIRCULAR MACHINE

FIELD OF THE INVENTION

This invention relates to circular knitting machines and in particular to the selection of the operating needles.

It provides a device for selecting the needles to pick up yarn from the feeds to form patterned hosiery articles. Circular knitting machines are known to consist essentially of one or more cylinders comprising grooves in their outer cylindrical surface.

BACKGROUND OF THE INVENTION

The grooves represent guides for the needles. During the needle travel stitch loops are formed by cooperation with the sinkers. The basic stitch forming process is described with reference to FIG. 1 which illustrates the prior art.

The cylinder is indicated by 1 and its groove by 2.

The number of grooves is equal to the number of needles 3. The needles reciprocatingly slide within the grooves.

Generally, the number of grooves and needles is between 200 and 400 per cylinder.

The needles operate with a reciprocating movement between a maximum position and a minimum position. They are moved by knitting cams, not shown.

The cylinder is rotated. The needles rotate with the cylinder and during their reciprocating movement the needles are fed with yarn when they reach their highest point of travel. This occurs when the needles are in a fixed angular position. When producing hosiery articles, generally only part of the available needles are used at the same time and in the same manner, with the exception of plain knitwork layers. In plain knitwork layers all the needles are operated between their maximum and minimum level, and all are fed with yarn at each knitting course, and all moved in the same manner.

When the machine is not producing plain knitwork, in order to produce other types of knitwork (such as mesh or patterned knitwork) some needles are required to produce stitch loops while others have to be raised to an intermediate level to take up yarn without clearing the previous stitch, to form a tuck stitch, or have to be raised with a certain delay so that they do not pick up the yarn fed into a certain angular position and therefore do not form new loops with it. In other words a needle selection has to be made. This means that for each revolution of the cylinder a certain number of needles must undergo a certain travel and a certain number of other needles must undergo a certain different travel or indeed undergo no travel.

This selection is made by the jacks 4 which slide in the same grooves as the needles lying above them, and which move these latter to a higher level in order to seize the yarn. When the jacks have moved the needle into its working position they withdraw from the needle butt and return downwards. If the needle, after completing its task of seizing the yarn and forming the stitch loop and therefore being at its minimum level, is not required to pick up a further yarn from another feed it remains at this level because its control jack remains in its lower rest position.

The jack 4 has a special shape which corresponds to a precise function. Although not shown on the drawing, it is slightly curved, or bowed, in a direction orthogonal to the plane of the drawing. This curvature keeps the jack lightly forced towards the inside of the groove and ensures its accurate positioning and lack of vibration by keeping it properly adhering to the walls of the groove and requires, the application of a force to move it either axially or radially.

The shank of the jack comprises a plurality of projections in its lower part.

The highest projection 5, namely the upper guide butt, comes into engagement with its own control cam 6 which again urges the jack downwards when it has completed its task of pushing the needle 3. Proceeding downwards along the jack shank there is a series of projections 7 known as teeth or pattern butts, which perform the actual selection described hereinafter and are provided in a number sufficient to provide the required number of selection combinations. At the foot of the jack there is the lower guide butt 8.

Said butt 8 cooperates with two fixed cams located about the base of the cylinder 1.

The cam 9 positions the butt 8 radially by urging it outwards so that it engages the cam 10, which moves the butt 8 vertically upwards.

All the jacks are urged outwards by the cam 9 so that they engage the cam 10, by which they are raised and urge their needle into its operating position.

The purpose of the selection mechanism and procedure is to exclude from this totality of jacks the jacks which control those needles which in order to form the desired knitwork have to be raised only to an intermediate level by means of the cam A to make a tuck stitch.

In the known art, the mechanism for selecting the needles, or more precisely for inactivating the jacks, consists of a plurality of members which come into contact with one of the butts 7 of the jack, and urge this jack back into the groove 2 so preventing it from making contact with the next lifting cam 10.

FIG. 1 shows schematically the movement involved in inactivating the jacks by means of levers 11 which rock about a horizontal pivot 12, in accordance with the prior art.

FIG. 1 shows by way of example two travel levers, of which a lever 11, pivoted at 12, is rotated into the inactivation position to interfere with that butt 7 located at its own level, thus urging it back into 2, whereas the lever 11', pivoted at 12', is rotated into its non-inactivation position so that it does not interfere with that butt 7 located at its own level, by virtue of being positioned within the gap between the two adjacent butts. The selection procedure therefore consists of producing contact between a certain number of levers 11 and a certain number of jacks 4 by way of pattern butts 7 located at the same height, by moving to their level only some of the levers 11. If a determined jack is to be left engaged with 10 while one or more of the levers 11 are to remain in the interference position, those butts corresponding to the height of these levers are removed from the jack. The number of levers available for selection control is generally equal to the number of pattern butts 7 available. The selection procedures of the known art generally consist of producing contact between the non-removed butts 7 of the jacks 4 and the inactivation members 11 by rotating said inactivation members into a position of non-interference with said butts. Obviously those levers 11 which are not required to inactivate the jacks whose butts 7 are in a corresponding position to them are kept in the non-interference position at the moment in which they would have made contact.

In circular knitting machines of high productivity the needle selection must be accomplished at high speed, as the selection speed governs the machine rotation speed and its productivity, and in addition the needle selector must occupy only a narrow angular space. In this respect, the angular sector occupied by the selector must be considered a "dead" space in which the jacks cannot move axially.

The angular width of said "dead" space is equal to the sum of the horizontal physical space occupied by the width of the lever 11, which must have a profile corresponding to gradual approach, and the space determined by the selector response time, which is given by the product of the speed of rotation of the machine cylinder and the time taken by the selector device to switch the lever 11 between its interference position and its non-interference position.

The angular width of said dead space could be reduced by reducing its two component terms.

To reduce the angular space physically occupied by the lever 11, they all can be positioned at the same angular coordinate in a stacked arrangement which is described hereinafter. This is to reduce the angular space determined by the selector response times. Selectors of very low inertia must be constructed and actuators of high switching speed used. With regard to reducing the physical space occupied by the selection member 11 it has been proposed in the known art to stack a number of selection members 11 of rocker lever type with their approach profiles all at the same angular coordinate. This number should be equal to the available number of butts 7, and to arrange the electromagnetic actuators in a position opposite them on the other side of the pivot 12 in adjacent stacks. The stacks should be staggered because of their vertical bulk, these occupying a larger vertical space than the members 11. The length of the pivot 12 must then be such that the opposite end of the lever 11 is also presented at the different angular coordinate at which its actuator has been disposed and must therefore be substantially as long as the width of the stack of staggered adjacent actuators.

In the embodiments described in French patent No. 1,564,603 in the name of Mayer & Cie and in British patent No. 1,436,607 in the name of Precision Fukuhara Works Co. Ltd., the vertical space occupied by each electromagnetic actuator is about three times the vertical pitch of the selection levers; the magnetic actuators are therefore disposed side by side in threes and staggered vertically, the pivot 12 being as long as three side-by-side actuators. The selection member 11 is always in the same position, but its opposite end is positioned to correspond to the position of the magnetic actuator which controls it.

In European patent application No. 219,029 in the name of Lonati S. p. A. the actuators are arranged in fives staggered side by side, the pivot correspondingly having the length of five side-by-side actuators.

The electromagnetic selection action can be exercised directly on the lever member 11 by attraction and/or repulsion action on its opposite end as in the case of the said Mayer and Fukuhara patents. It can also be exercised indirectly as in the case of the said Lonati patent and British patent application No. 2,008,157 in the name of Shima Idea Center Co. Ltd., in which the electromagnetic actuator consists of a lever rocking between two positions, determined by the excitation of two electromagnets facing it in opposite positions, this lever controlling the selection lever 11.

The devices of the known art suffer from considerable drawbacks in their practical application because the needle selection involves rather large forces and is very arduous.

In this respect, as the end of the selection lever 11 is shaped for progressive action, for each jack inactivation procedure the end of the lever 11 gradually receives the reaction R of the jack which is urged into the groove 2. This reaction can be as high as several hundred grams, especially when the thrust is exerted on the highest butts, and it can be repeated with high frequency of the order of hundreds of times per second.

The rocking masses must be reduced to a minimum otherwise the selection and switching speeds would be reduced because of their inertia.

The requirement for rapid switching from one position to the other is in conflict with the requirement of strength to resist the periodic impact against the butts 7.

In European patent application No. 279,310 in the name of Lonati S. p. A. the selection lever is again in elongated form so that it presents itself to a plurality of side-by-side electromagnetic actuators disposed at its rear, but is lightened by being constructed of synthetic material with lightening slots, the use of metal being limited to that end of the lever 11 which comes into contact with the butts.

This expedient reduces the inertia of the lever 11, but means that the reaction R, the impacts and any vibration must all be withstood by this synthetic material, which even if fibre-reinforced is much less resistant than the normal steel used for mechanical construction. The jack reaction R is in fact transferred between the metal part and the pivot 12 via the synthetic material.

The present invention provides a low inertia selector device of high resistance to the reaction forces exerted by the jacks.

DETAILED DESCRIPTION OF THE INVENTION

Figure 1:
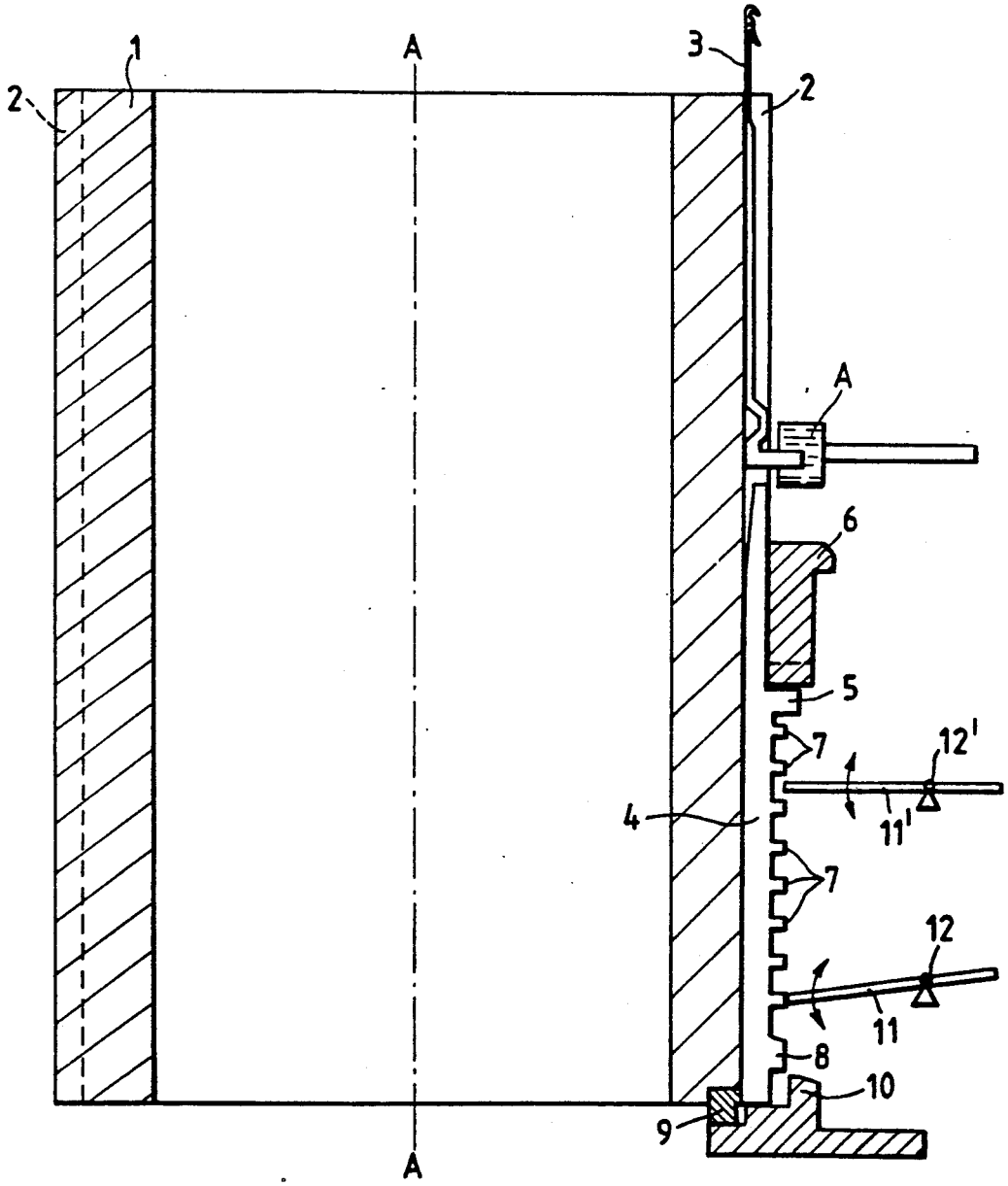
Figure 2:
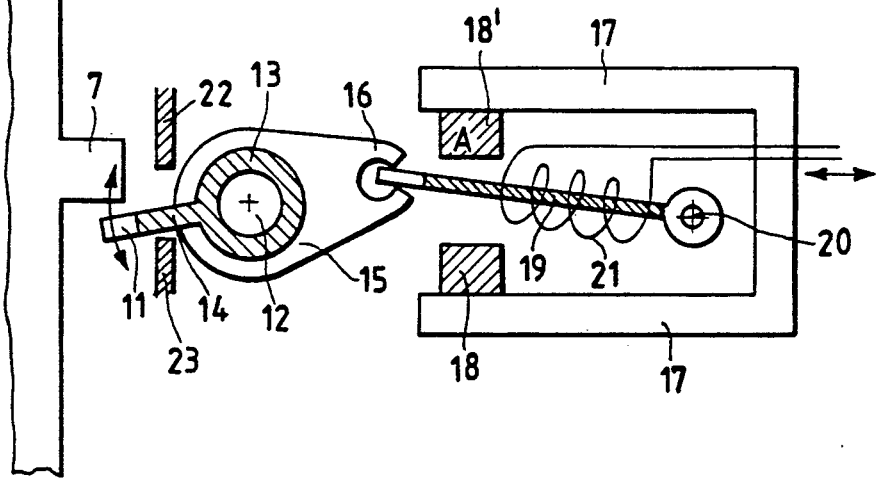
Figure 3A:
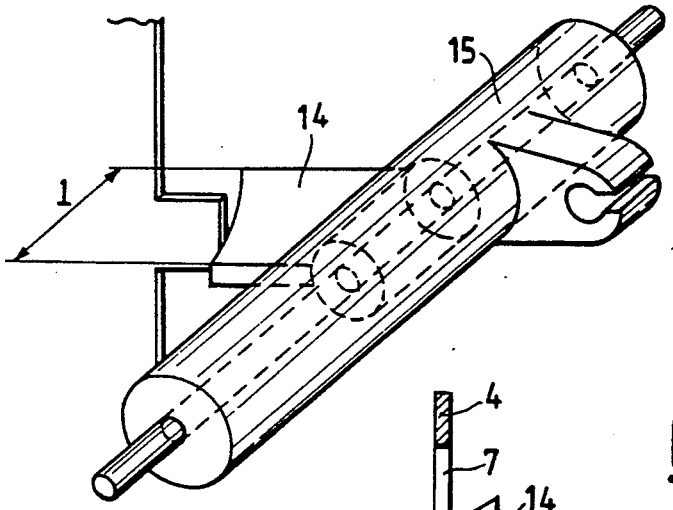
Figure 3B:
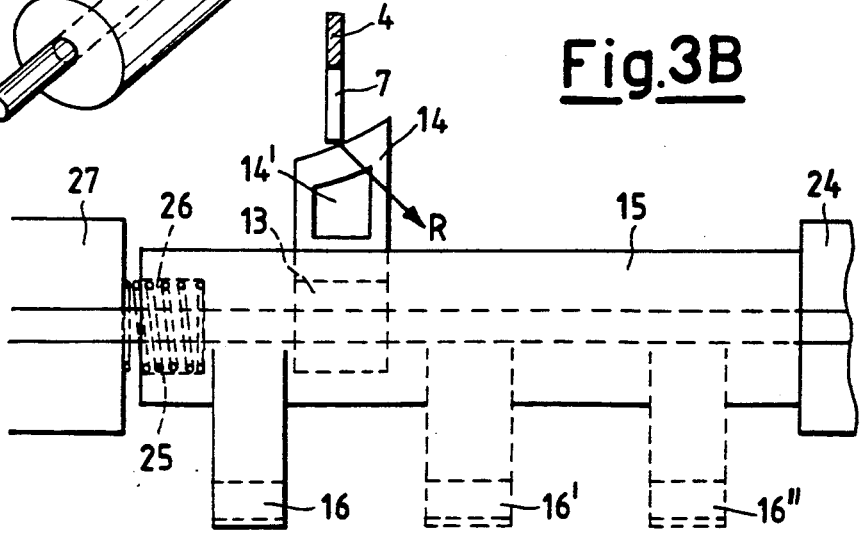

It is described with reference to FIGS. 2 and 3A and 3B, which show a typical embodiment thereof by way of non-limiting example. The selection member 11, which makes contact with the jack butts 7, has gradual profile for urging the jack into the cylinder groove, and is of one-piece metal construction comprising a bored sleeve 13 engaging directly on the metal pivot or rod 12, and a fin 14 carrying said gradual profile.

The sleeve 13 and the fin 14 comprise a single piece metal rocker arm, in which the width 1 of the fin 14 is determined by the required softness of the approach, is embedded in a cylinder 15 of synthetic material comprising an axial bore for the pivot 12 and carrying opposite the lever 11 a projection 16 of small width having therein a slot 28 which engages in the rearward magnetic actuator in one of its possible alternative positions 16, 16', 16''. . . , which preferably do not coincide with the position of the one-piece metal insert.

Figure 4:
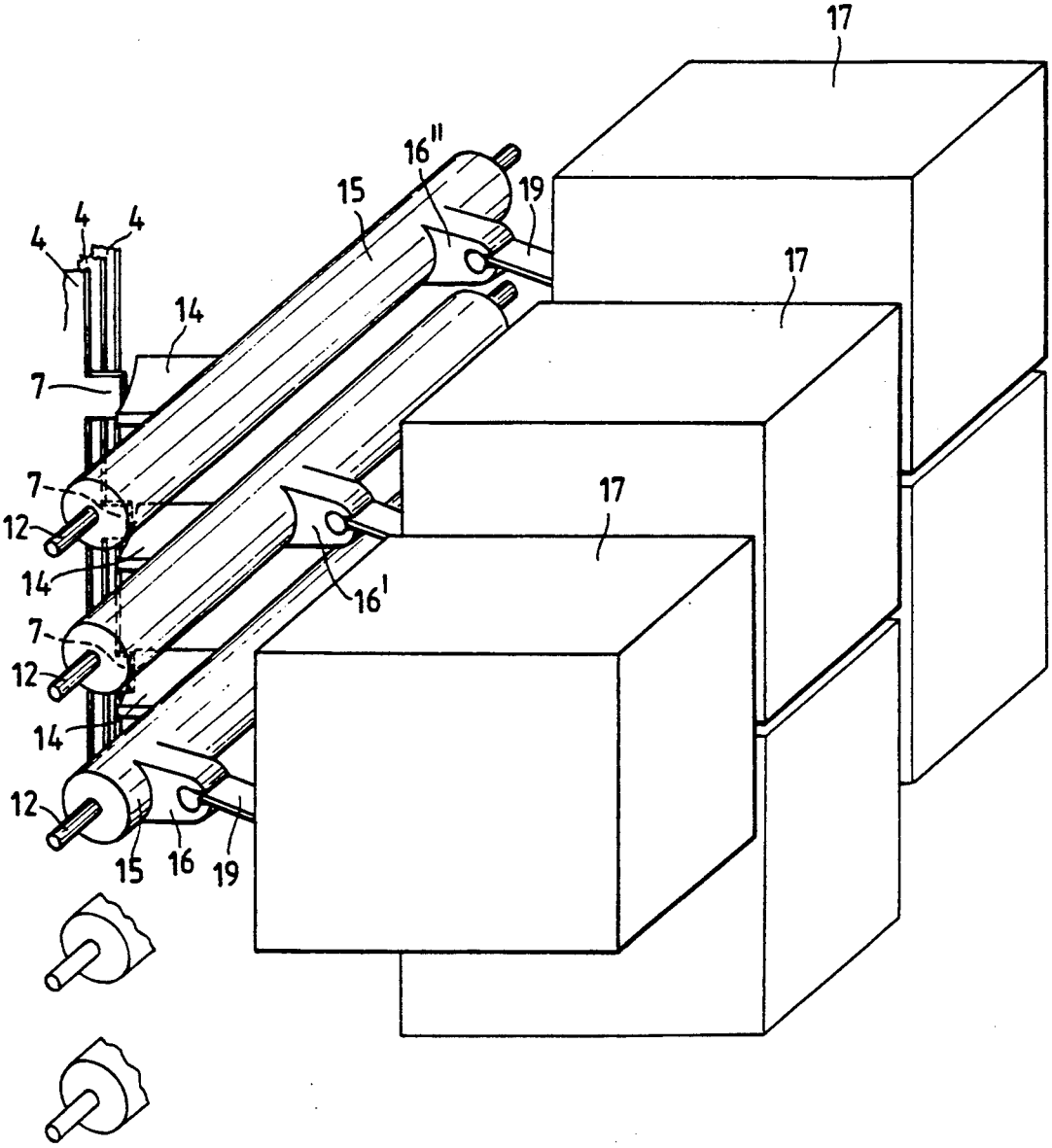

As in accordance with the aforesaid known art, all the selection members 11 are stacked parallel to each other so as to present the butts 7 with the profiles of the fins 14 along the same generator of the cylinder, whereas the adjacent rear levers 16 are disposed mutually staggered in the positions 16, 16', 16''. . . so as to allow the more bulky magnetic actuators located to their rear to occupy a vertical space equal to a multiple of the height occupied by the selection members. This arrangement is illustrated schematically in FIG. 4.

The material can be a polymer material, a resin or a combination of these, possibly reinforced with fibres such as glass fibres or carbon fibres.

The width of the projections 16 is of the same order of magnitude as the width of the rocker arm or shaft of the magnetic actuator.

One or more lightening holes 14' can be provided in the fin 14. The metal sleeve 13 preferably has its outer surface machined to provide a good grip for the resin which encloses it. The electromagnetic actuator consists of a frame 17, which encloses the magnetic circuit and supports two permanent magnets 18 and 18' of opposite polarity. Within the frame 17 there is a rocker arm or shaft 19 of ferromagnetic material, pivoted at pivot 20. An electric winding in the form of a plurality of turns 21 surrounds the ferromagnetic shaft 19 to give it a NS or SN polarity when traversed by electric current, depending on the direction of the current through it, so making said shaft move upwards or downwards by the attraction of one of the permanent magnets and the repulsion of the other.

The effect of the electromagnetic action is to cause the end of the ferromagnetic shaft 19 to rotate upwards or downwards, so that end engaged in 16 causes the selection member 11 to rotate in the opposite direction, ie from the position in which it interferes with the butts 7 to the position of non-interference and vice versa.

The shaft 19 is preferably prevented from coming into contact with permanent magnets 18 and 18' by providing travel stops 22 and 23 at the fin 14.

The electromagnetic actuator therefore undergoes no impact or stress, and can therefore be constructed of low mass. All stresses deriving from the jack reaction are absorbed upstream. Any vibrations are damped by the lever 16, which is constructed fork-shaped of synthetic material.

The jack reaction R is not exactly perpendicular to the axis of the pivot 12 but is inclined in the direction of rotation of the circular knitting machine.

In order to correctly discharge the axial components of the reaction R onto the body 15 and prevent knocking, it is kept constantly adhering to that abutting part 24 of the support for the pivot 12 which faces away from the direction of motion, by the action of a biasing means such as a spring 25 located in an axial cavity 26 in the body 15 at the end distant from the abutting part 24, and kept under compression by the abutting part 27 of the support for the pivot 12.

In contrast, French patent No. 1,564,603 uses a spring for exerting the opposite action. It is used to absorb and damp the axial component of the reaction R while allowing the selector to move, rather than to prevent axial movement of the cylindrical body 15.

The selector device according to the invention has numerous advantages over devices of the known art.

The jack selection member pivoted at 12 has a very low inertia towards rotation, because those masses which rock about the relatively longer radii have been reduced to their useful length instead of uselessly extending along the entire cylinder 15. From experimental prototype tests the entire selector device according to the present invention indicates a switching time of less than 2 milliseconds in passing from one position to the other.

The radial forces due to the jack reaction are all absorbed by the single metal part comprising the sleeve 13 and the fin 14. The synthetic material portion of contraction is required only to withstand axial forces and the small torsional moments.

The electromagnetic actuators also have high positional stability because the electromagnetic energization serves only for switching the rocker arm or ferromagnetic shaft, which is then retained in a stable position by the permanent magnets 18 and 18'.

Thus even if energization irregularities occur, the rocker arm shaft cannot permanently assume an intermediate position.

I claim:

1. An electromagnetic device for selecting needles in a circular knitting machine, wherein the device has a rotating needle cylinder, and wherein the device comprises:

a) a pusher jack for activating a corresponding needle, wherein said jack is housed and is slidable in a groove of the needle cylinder and wherein said jack has at least one pattern butt projecting therefrom;

b) a selection member for cooperating with said pattern butt for preventing said jack from activating its corresponding needle by moving into and out of engagement with said pattern butt, wherein said selection member comprises:

1) a cylinder with a bore therethrough, wherein said cylinder has a projection extending therefrom, and wherein said projection has a slot therethrough;

2) a rocker arm having a sleeve with a bore therethrough and a fin extending from said sleeve, wherein said rocker arm and said cylinder projection are substantially equal in width and said width is substantially less than the length of said cylinder, and wherein said sleeve is positioned within said cylinder bore and wherein said fin is adapted for cooperating with its corresponding pattern butt;

3) a rod extending through said sleeve bore so that said cylinder can pivot about said rod for moving said fin of said selection member into and out of engagement with its corresponding pattern butt of said jack;

c) actuating means for moving said selection member into and out of engagement with its corresponding pattern butt of said jack by cooperating with said cylinder projection of said selection member to selectively prevent said jack from activating its corresponding needle.

2. The device of claim 1 wherein said actuating means comprises:

a) a frame having two members extending opposite one another;

b) two permanent magnets, each positioned on said opposite frame members, wherein each of said magnets have a different polarity;

c) a pivot positioned within said frame;

d) a ferromagnetic shaft for pivoting about said frame pivot, wherein said ferromagnetic shaft extends between said magnets from said frame pivot to said cylinder projection, and wherein said ferromagnetic shaft is adapted to cooperate with said slot of said projection; and e) an electric wire coiled about said ferromagnetic shaft so that when said wire conducts an electric current in one direction, said ferromagnetic shaft is attracted to one of said two magnets and when said wire conducts an electric current in an opposite direction, said ferromagnetic shaft is attracted to the other of said two magnets; so that when said ferromagnetic shaft is attracted to one of said two magnets said ferromagnetic shaft is adapted to move said cylinder projection for pivoting said rocker arm so that said selection member prevents said jack from activating its corresponding needle.

3. The device of claim 1 wherein said selection member comprises a polymer.

4. The device of claim 3 further comprising fibers, wherein said polymer is reinforced with said fibers.

5. The device of claim 2 further comprising a pair of stops adapted for preventing said ferromagnetic shaft from contacting said magnets.

6. The device of claim 1 further comprising a biasing means positioned about said rod for urging said cylinder in the direction of said needle cylinder rotation.

* * * * *